US006380678B1

(12) United States Patent
Kim

(10) Patent No.: US 6,380,678 B1
(45) Date of Patent: Apr. 30, 2002

(54) PLASMA DISPLAY PANEL

(75) Inventor: Jae Sung Kim, Kyongsangbuk-do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/512,273

(22) Filed: Feb. 24, 2000

(30) Foreign Application Priority Data

Feb. 24, 1999 (KR) ..... 99/6148

(51) Int. Cl.[7] ..... H01J 17/49
(52) U.S. Cl. ..... 313/586; 313/582
(58) Field of Search ..... 313/582, 491, 313/583, 631, 284, 292, 581, 587

(56) References Cited

U.S. PATENT DOCUMENTS 5,742,117 A * 4/1998 Spindt et al. ..... 313/422
6,157,123 A * 12/2000 Schmid et al. ..... 313/422
6,307,327 B1 * 10/2001 Xie et al. ..... 315/169.4

* cited by examiner

*Primary Examiner*—Robert H. Kim
*Assistant Examiner*—Jurie Yun
(74) *Attorney, Agent, or Firm*—Fleshner & Kim, LLP

(57) ABSTRACT

A plasma display panel includes a plurality of address electrodes successively formed on a rear substrate at a certain distance, a plurality of upper electrodes successively formed on a front substrate opposite to the rear substrate to orthogonally cross the address electrodes, an isolation wall formed between the rear substrate and the front substrate to form a plurality of lattice-shaped discharge areas in areas where the address electrodes cross the upper electrodes, and a plurality of floating electrode pairs, wherein each floating gate pair being formed in a corresponding discharge are, two floating gate electrodes in each pari being formed on two opposite sides of the isolation wall respectively, and the sides corresponding to both sides of the corresponding electrode.

35 Claims, 8 Drawing Sheets

PLASMA DISPLAY PANEL

BACKGROUND OF THE INVENTION

1. Field of the Invention

The present invention relates to a plasma display panel.

2. Background of the Related Art

Generally, a plasma display panel and a liquid crystal display (LCD) have lately attracted considerable attention as the most practical next generation display of flat panel displays. In particular, the plasma display panel has higher luminance and a wider visible angle than the LCD. For this reason, the plasma display panel is widely used as a thin type large display such as an outdoor advertising tower, a wall TV and a theater display. Unlike a cathode ray tube (CRT), the plasma display panel displays a picture image through a discharge in each discharge cell.

FIG. 1 shows a structure of a related art plasma display panel. As shown in FIG. 1, the related art plasma display panel includes an upper structure and a lower structure. In the upper structure, a pair of upper electrodes are formed on a surface of a front glass substrate 1, and a dielectric layer 2 is formed on the upper electrode 4 by printing. A passivation film is deposited on the dielectric layer 2. In the lower structure, a lower electrode 12 is formed on a rear glass substrate 11, and an isolation wall 6 is formed to prevent crosstalk of adjacent cells formed between the upper electrode 4 and the lower electrode 12 from occurring. Phosphors 8, 9 and 10 are formed around the isolation wall 6 and the lower electrode 12. A discharge area 5 is formed by sealing an inert gas in a space between the upper structure and the lower structure.

In the above structure, if a driving voltage is applied to the upper electrodes 4, area discharge occurs in surfaces of the dielectric layer 2 and the passivation film 3 in the discharge area 5, thereby generating ultraviolet rays 7. The phosphors 8, 9 and 10 are excited by the ultraviolet rays 7. Thus, the excited phosphors 8, 9 and 10 are emitted so as to display colors of respective pixels.

In other words, electrons in each discharge cell are accelerated to negative electrodes by the driving voltage. The accelerated electrons come into collision with an inert mixing gas filled in the discharge cell at a pressure of 400~500 torr. The inert mixing gas is a penning mixing gas containing He as a main component and further containing Xe and Ne. The inert gas is excited by the collision to generate ultraviolet rays having a wavelength of 147 nm. The ultraviolet rays come into collision with the phosphors 8, 9 and 10 surrounding the lower electrode 12 and the isolation wall 6, so that the phosphors 8, 9 and 10 are emitted in a visible right ray region.

FIG. 2 is a block diagram showing a plane structure of the upper electrode formed on the upper substrate of the plasma display panel. As shown in FIG. 2, the upper electrode includes bus electrodes 4-1 and 4-2 to which a discharge voltage is externally applied, and two transparent electrodes 4-1' and 4-2' connected to the bus electrodes 4-1 and 4-2, for generating discharge by the discharge voltage. The electrodes are divided into a plurality of areas by the isolation wall 6 formed on the lower substrate. One of the divided areas corresponds to one pixel. At this time, the bus electrodes 4-1 and 4-2 to which the discharge voltage is applied have stripe shapes, and the discharge voltage is applied from the bus electrodes 4-1 and 4-2 to the transparent electrodes 4-1' and 4-2', so that discharge occurs between the transparent electrodes 4-1' and 4-2' and their adjacent transparent electrodes.

The aforementioned related art plasma display panel has several problems.

Emitting efficiency of the aforementioned plasma display panel depends on the intensity of discharge between the transparent electrodes. That is to say, the related art plasma display panel has a low discharge characteristic if the distance between the transparent electrodes is short while it has a high discharge characteristic if the distance between the transparent electrodes is long. This is because that positive column discharge is possible when the distance between the transparent electrodes is long. However, if the distance between the transparent electrodes is long, the size of a discharge start voltage must increase proportionally. This increases power consumption.

SUMMARY OF THE INVENTION

Accordingly, the present invention is directed to a plasma display panel that substantially obviates one or more of the problems due to limitations and disadvantages of the related art.

An object of the present invention is to provide a plasma display panel which generates high discharge with the same discharge start voltage.

Other object of the present invention is to provide a plasma display panel which increases a discharge distance without increasing the distance between transparent electrodes.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel according to the present invention includes a plurality of address electrodes successively formed on a rear substrate at a certain distance, a plurality of upper electrodes successively formed on a front substrate opposite to the rear substrate to orthogonally cross the address electrodes, an isolation wall formed between the rear substrate and the front substrate to form a plurality of lattice-shaped discharge areas in areas where the address electrodes cross the upper electrodes, and a plurality of floating electrode pairs, wherein each floating gate pair being formed in a corresponding discharge area, two floating gate electrodes in each pair being formed on two opposite sides of the isolation wall respectively, and the sides corresponding to both sides of the corresponding upper electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plasma display panel according to the present invention is characterized in that a floating electrode is additionally formed in addition to a transparent electrode formed on an upper substrate.

First Embodiment

Figure 1:
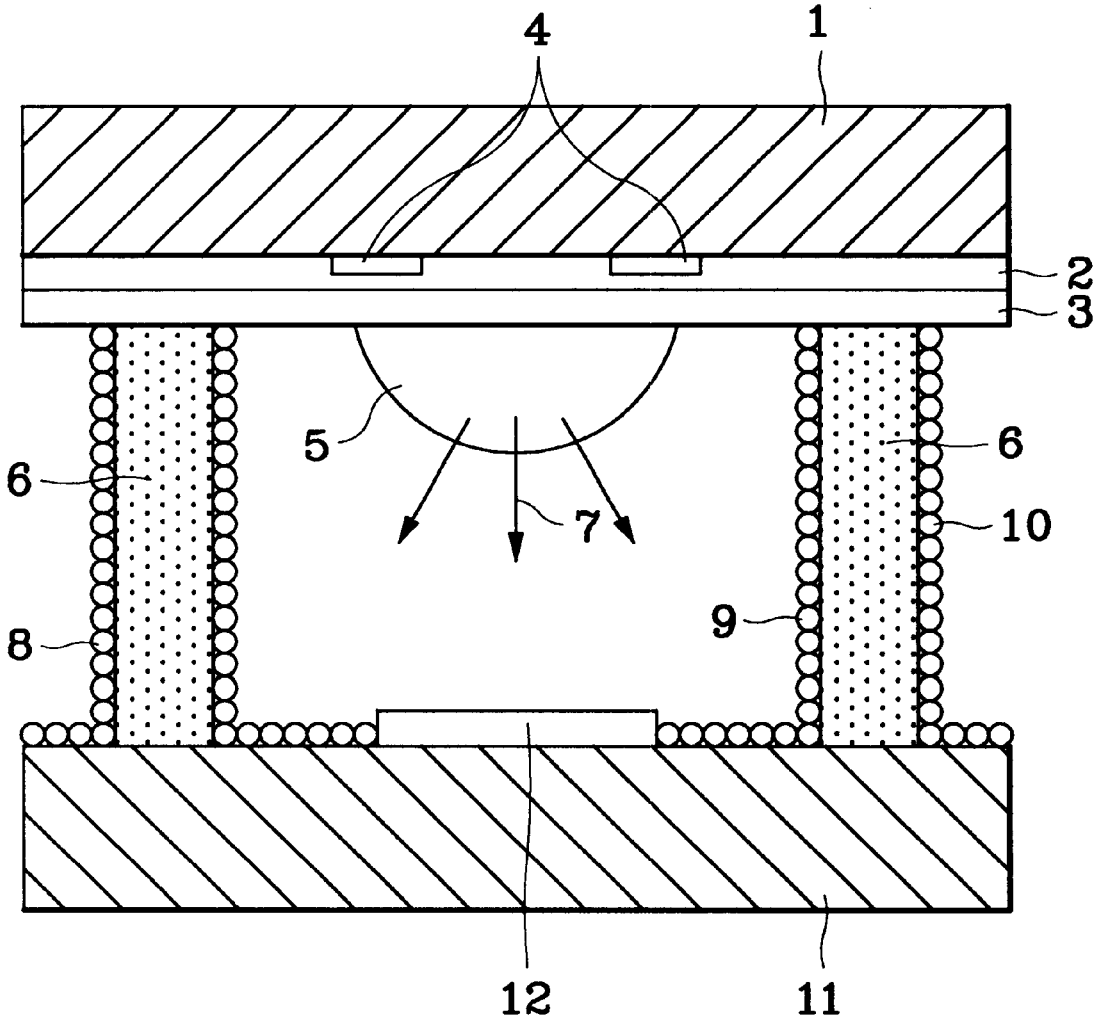
FIG.1 Related Art
FIG. 1 shows a sectional structure of a related art plasma display panel.
Figure 2:
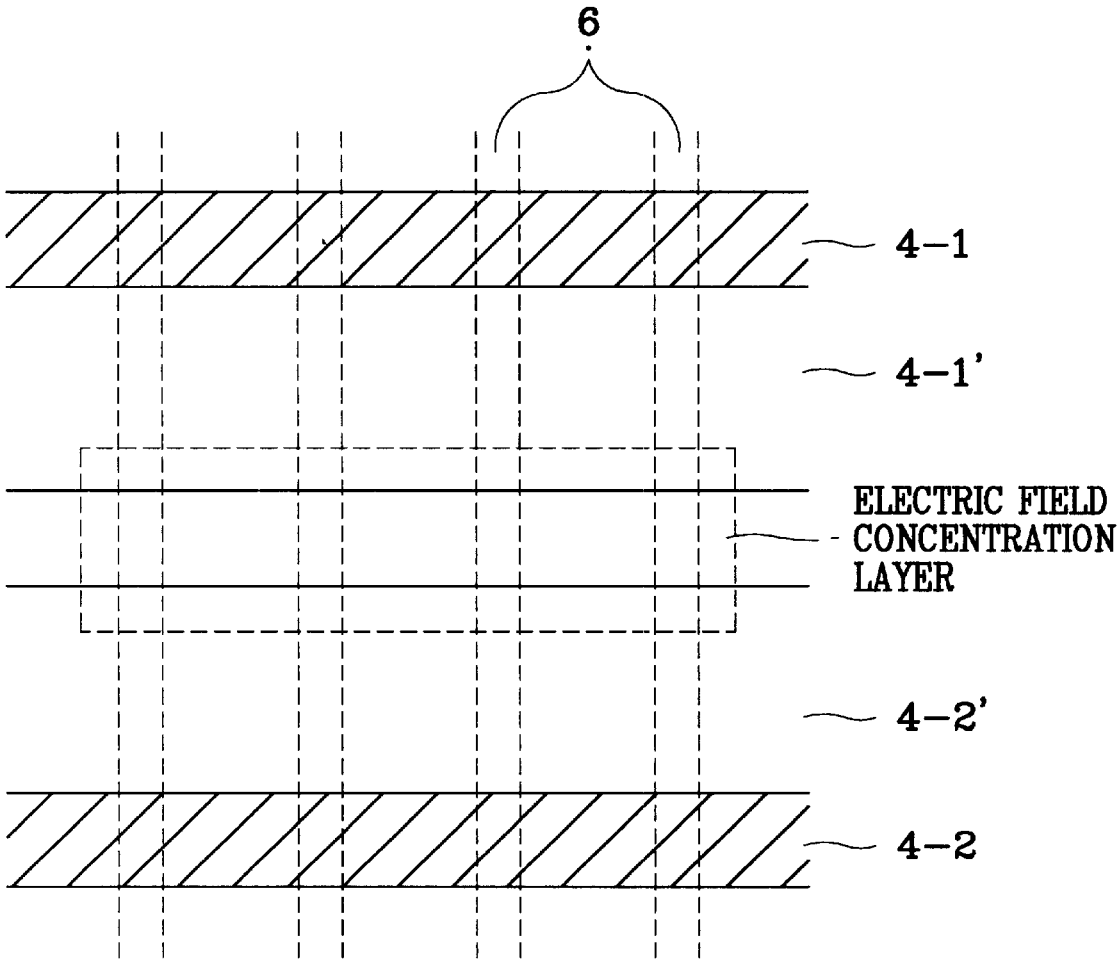
FIG.2 Related Art
FIG. 2 is a block diagram showing a plane structure of upper electrodes formed on an upper substrate in a related art plasma display panel.
Figure 3:
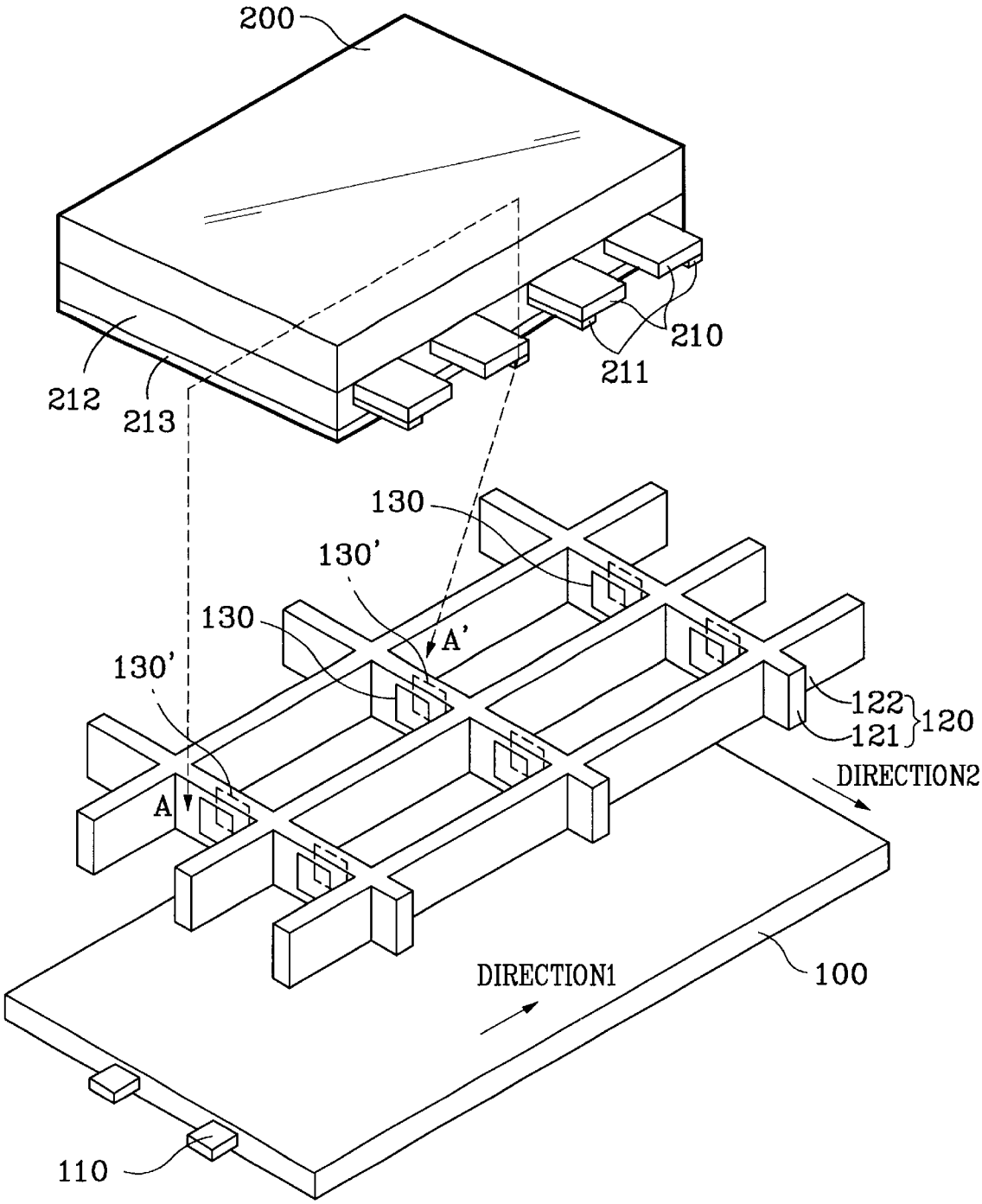
FIG. 3 is a block diagram showing a structure of a plasma display panel having a lattice-shaped isolation wall according to the first embodiment of the present invention.

As shown in FIG. 3, a plasma display panel according to the first embodiment of the present invention includes a lower substrate 100, a plurality of address electrodes 110 formed on the lower substrate (or a rear substrate) 100 at a certain interval, an upper substrate (or a front substrate) 200, upper electrodes 210 and 211 formed on the upper substrate 200 to orthogonally cross the address electrodes 110, a lattice-shaped isolation wall 120 to form a plurality of discharge areas in areas where the address electrodes 110 cross the upper electrodes 210 and 211, and a plurality of floating electrodes 130 and 130' in pairs formed on opposite sides of the isolation wall in each discharge area to oppose each other. The respective floating electrode pairs 130 and 130' are parallel to the upper electrodes 210 and 211 on the opposite sides of the isolation wall in each discharge area. As shown in FIG. 3, the upper electrode includes a first upper electrode 210 and a second upper electrode 211 formed on one of lower edges at both sides of the first upper electrode 210. A dielectric layer 212 and a passivation film 213 are sequentially formed on the upper electrodes 210 and 211.

Meanwhile, the address electrodes 110 are successively formed with stripe shapes in a first direction on the lower substrate 100 at a certain interval. The upper electrodes 210 and 211 are successively formed on the upper substrate 200 opposite to the lower substrate 100 in a second direction to cross the address electrodes 110. The first direction and the second direction cross each other at a predetermined angle. In this embodiment, the first direction and the second direction orthogonally cross each other. The first upper electrode 211 is formed of metal and acts as a bus line while the second upper electrode 210 is a transparent electrode and acts as a discharge electrode.

Meanwhile, as shown in FIG. 3, the lattice-shaped isolation wall 120 is formed between the upper substrate 200 and the lower substrate 100, and includes a plurality of first bars 121 and a plurality of second bars 122. The first bars 121 successively extend to the second direction at a certain interval while the second bars 122 successively extend to the first direction at a certain interval. By the lattice-shaped isolation wall, the discharge areas are formed in areas where the address electrodes 110 cross the upper electrodes 210 and 211. That is to say, each discharge area is formed with a lattice shape, and discharge occurs in the discharge area by voltages applied to the address electrodes 110 and the upper electrodes 210 and 211.

Meanwhile, the two floating electrodes in pairs of the plurality of floating electrodes 130 and 130' are formed on the two sides opposite to the second direction of the isolation wall 120 to oppose each other. That is to say, the sides in the discharge areas, where the floating electrode pairs 130 and 130' are formed, correspond to sides of the first bars 121 which extend to the second direction along the upper electrodes 210 and 211. The respective floating electrode pairs 130 and 130' oppose each other on the same line as the first direction along the address electrodes 110. Preferably, the floating electrode pairs 130 and 130' are formed of a conductive material such as metal and indium Tin Oxide (ITO).

Figure 4:
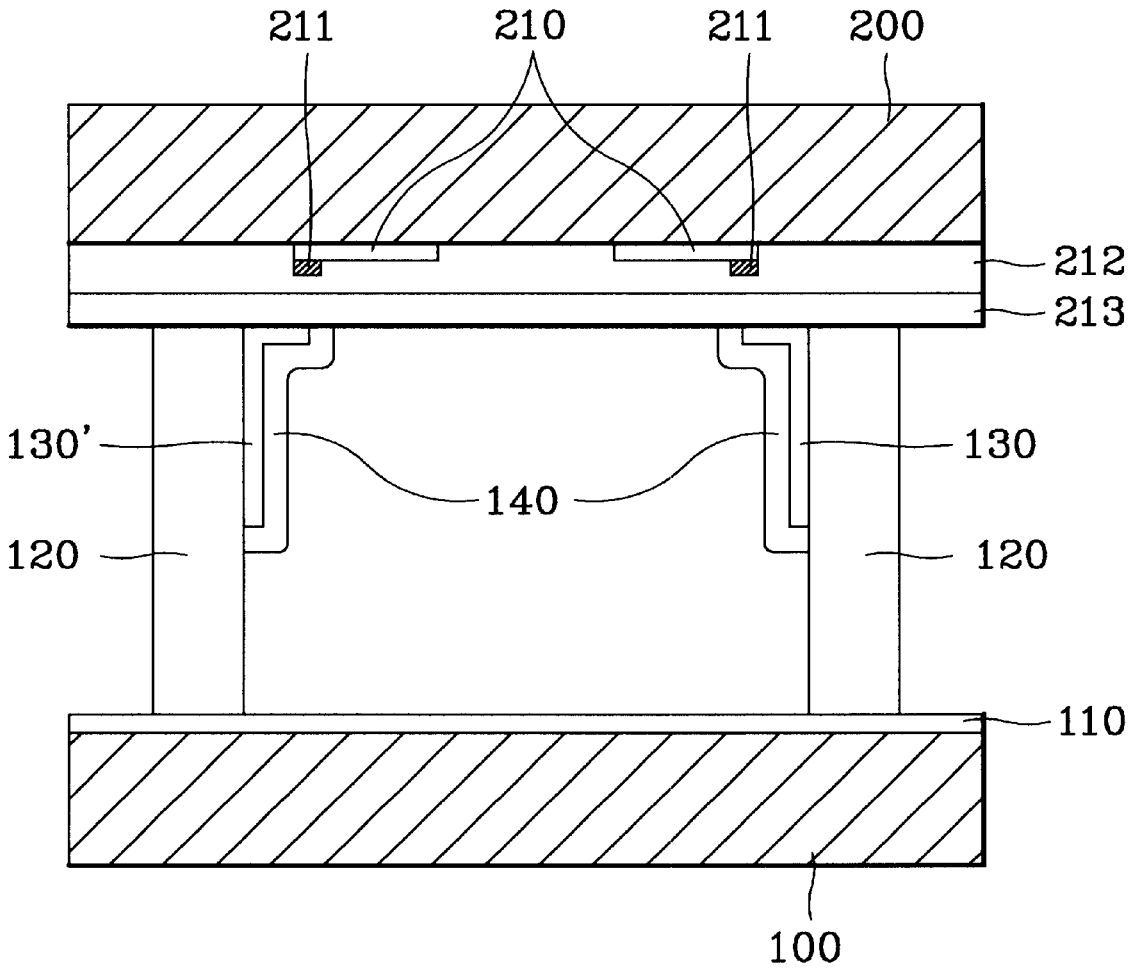
FIG. 4 is a diagram showing a section taken along line A–A' of FIG. 3.

In FIG. 3, the respective floating electrode pairs 130 and 130' are formed only at the sides of the isolation wall 120. The respective floating electrode pairs 130 and 130' may be formed extended from the upper sides of the first bars 121 to some portion of the upper substrate 200, as shown in FIG. 4. Also, the plasma display panel according to this embodiment may further include a passivation film 140 which covers the respective floating electrode pairs 130 and 130' as shown in FIG. 4. Such a plasma display panel including the passivation film 140 has an advantage that the floating electrodes 130 and 130' can be protected from charged particles generated by the discharge.

The operation of the aforementioned plasma display panel according to the first embodiment of the present invention will be described below.

If address discharges occur in the address electrodes 110 and the upper electrodes 210 and 211, wall charges are generated on the passivation film 213 of the upper substrate 200. The generated wall charges act to lower a discharge sustain voltage applied to the upper electrodes 210 and 211 so that sustain discharge can occur. At this time, the wall charges are generated on the passivation film 140 as well as the passivation film 213. This is because that a predetermined voltage is induced to the floating electrode pairs 130 and 130' by area charges in the lattice-shaped discharge areas. Thus, the wall charges are generated on the sides of the isolation wall 120 in which the floating electrode pairs 130 and 130' are formed. Furthermore, discharge occurs between the two floating electrodes of the respective floating electrode pairs 130 and 130', formed on the sides of the first bars 121 to oppose each other.

Second Embodiment

A plasma display panel having floating electrodes according to the second embodiment of the present invention will be described with reference to FIGS. 5 and 6.

The second embodiment is different from the first embodiment in that discharge areas have double volumes more than the discharge areas in the first embodiment. To obtain double volumes, the same isolation wall is formed on both an upper substrate and a lower substrate. At this time, the isolation wall on the upper substrate is engaged with that on the lower substrate. Thus, when mating them each other, a discharge area two times of that in the first embodiment is obtained.

Figure 5:
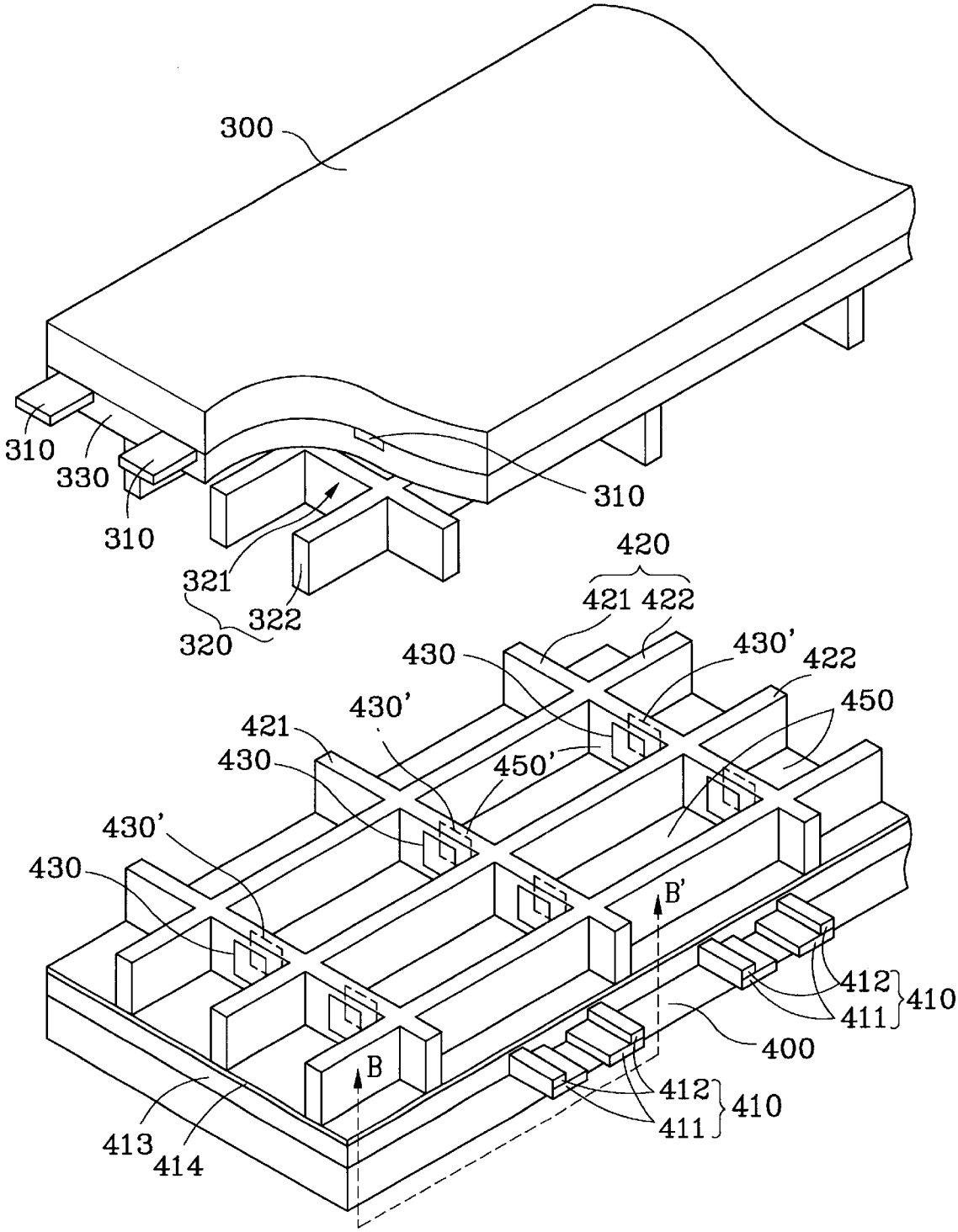
FIG. 5 is a diagram showing a structure of a plasma display panel having a lattice-shaped isolation wall according to the second embodiment of the present invention.
Figure 6:
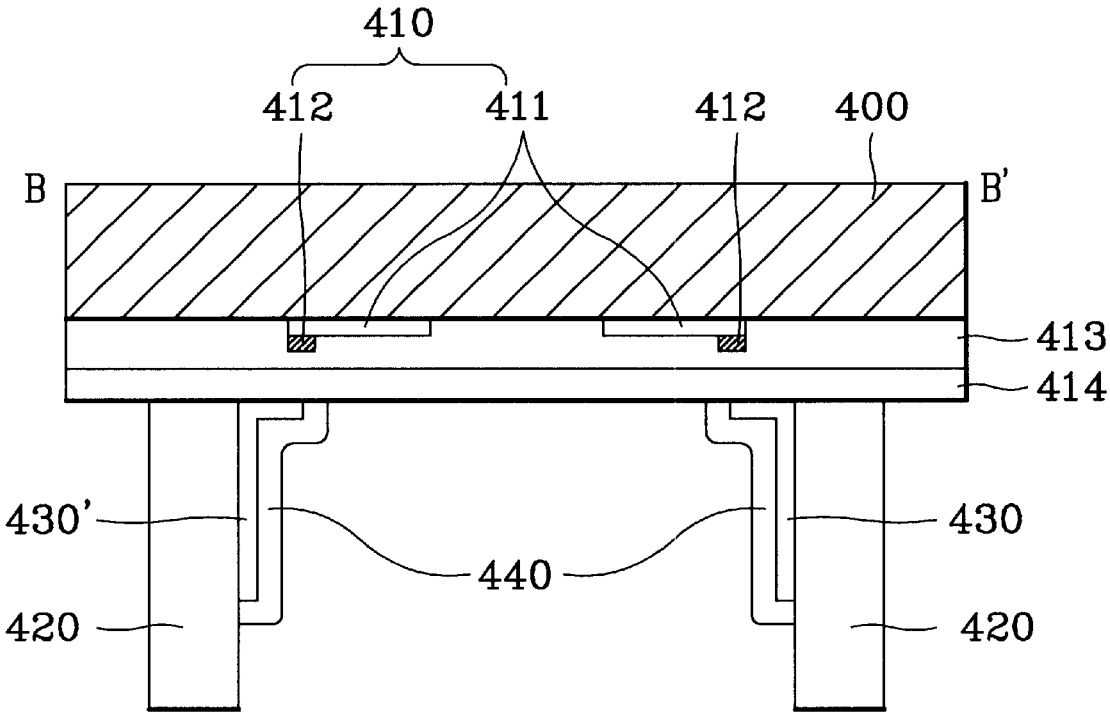
FIG. 6 is a diagram showing a section taken along line B–B' of FIG. 5.

As shown in FIG. 5, the plasma display panel according to the second embodiment of the present invention includes a lower substrate 300, a plurality of address electrodes 310 formed on the lower substrate 300 at a certain interval, an upper substrate 400, a plurality of upper electrodes 410 formed on the upper substrate 400 to cross the address electrodes 310, a lattice-shaped upper isolation wall 420 formed on the upper substrate 400 to form a plurality of discharge areas in areas where the address electrodes 310 cross the upper electrodes 410, a lower isolation wall 320 formed on the lower substrate 300 at the same shape as the upper isolation wall 420 to form a plurality of discharge areas 450 by mating with the upper isolation wall 420, and a plurality of floating electrode pairs 430 and 430' formed on two sides 450' opposite to the upper isolation wall 420 in each discharge area 450 so that two floating electrodes in pairs oppose each other. The respective floating electrode pairs 430 and 430' are parallel to the upper electrodes 410 on the opposite sides 450' of the isolation wall 420 in each discharge area 450. As shown in FIG. 5, the upper electrode 410 includes a first upper electrode 411 and a second upper electrode 412 formed on one of lower edges at both sides of the first upper electrode 411. A dielectric layer 413 and a passivation film 414 are sequentially formed on the upper electrodes 410.

Meanwhile, the address electrodes 310 are successively formed with stripe shapes on the lower substrate 300 in a first direction. The upper electrodes 410 are successively formed on the upper substrate 400 opposite to the lower substrate 300 in a second direction to cross the address electrodes 310. The first direction and the second direction cross each other at a predetermined angle. In this embodiment, the first direction and the second direction orthogonally cross each other. The first upper electrodes 411 are formed of metal and act as bus lines while the second upper electrodes 412 are transparent electrodes and act as discharge electrodes.

Meanwhile, as shown in FIG. 5, the lattice-shaped isolation wall 420 is formed on the passivation film 414 located on the upper substrate 400, and includes a plurality of first bars 421 and a plurality of second bars 422. The first bars 421 successively extend to the second direction at a certain interval while the second bars 422 successively extend to the first direction at a certain interval. By the lattice-shaped upper isolation wall 420, some portions for forming the discharge areas are formed in areas where the address electrodes 310 cross the upper electrodes 410. That is to say, the portions for forming each discharge area are formed with lattice shapes.

Meanwhile, the lower isolation wall 320 is formed on the passivation film 330 on the lower substrate 300 and the address electrodes 310, and includes a plurality of first bars 321 and a plurality of second bars 322. The first bars 321 successively extend to the second direction at a certain interval while the second bars 322 successively extend to the first direction at a certain interval. By the lattice-shaped lower isolation wall 320, the discharge areas 450 are formed in areas where the address electrodes 310 cross the upper electrodes 410. That is to say, each discharge area 450 is formed with a lattice shape, and discharge occurs in the discharge area by voltages applied to the address electrodes 310 and the upper electrodes 410.

Meanwhile, the two floating electrodes in pairs of the plurality of floating electrodes 430 and 430' are formed on the two sides opposite to the second direction of the isolation wall 420 constituting the corresponding discharge area 45, so that the two floating electrodes oppose each other. That is to say, the sides 450' in the discharge areas 450, where the floating electrode pairs 430 and 430' are formed, correspond to sides of the first bars 421 which extend to the second direction along the upper electrodes 410. The respective floating electrode pairs 430 and 430' oppose each other on the same line as the first direction along the address electrodes 310. Preferably, the floating electrode pairs 430 and 430' are formed of a conductive material such as metal and ITO.

In FIG. 5, the respective floating electrode pairs 430 and 430' are formed only at the sides 450' of the upper isolation wall 420. Alternatively, the respective floating electrode pairs 430 and 430' may be formed extended from the sides on the first bars 421 to some portion of the upper substrate 400, as shown in FIG. 6. Also, the plasma display panel according to this embodiment may further include a passivation film 440 which covers the respective floating electrode pairs 430 and 430' as shown in FIG. 6. Such a plasma display panel including the passivation film 440 has an advantage that the floating electrodes 430 and 430' can be protected from charged particles generated by the discharge. At this time, if the respective floating electrode pairs 430 ad 430' are formed on the upper isolation wall 420 only, the passivation film 440 is deposited on the respective floating electrode pairs 430 and 430'. If the respective floating electrode pairs 430 and 430' are formed extended from the upper sides of the first bars 421 to some portion of the passivation film 414 on the upper substrate 400, the passivation film 440 is deposited extended to the floating electrode pairs 430 and 430' and some portion of the passivation film 414.

Third Embodiment

In a plasma display panel according to the third embodiment of the present invention, the floating electrode pairs 430 and 430' may be formed extended from the upper side of the upper isolation wall 420 to some portion of the dielectric layer 413. At this time, the passivation film 440 may be formed on the entire surface of the dielectric layer 413 and the entire sides 450' of the upper isolation wall 420. In this case, the passivation film 414 of FIG. 6 is not required.

Figure 7:
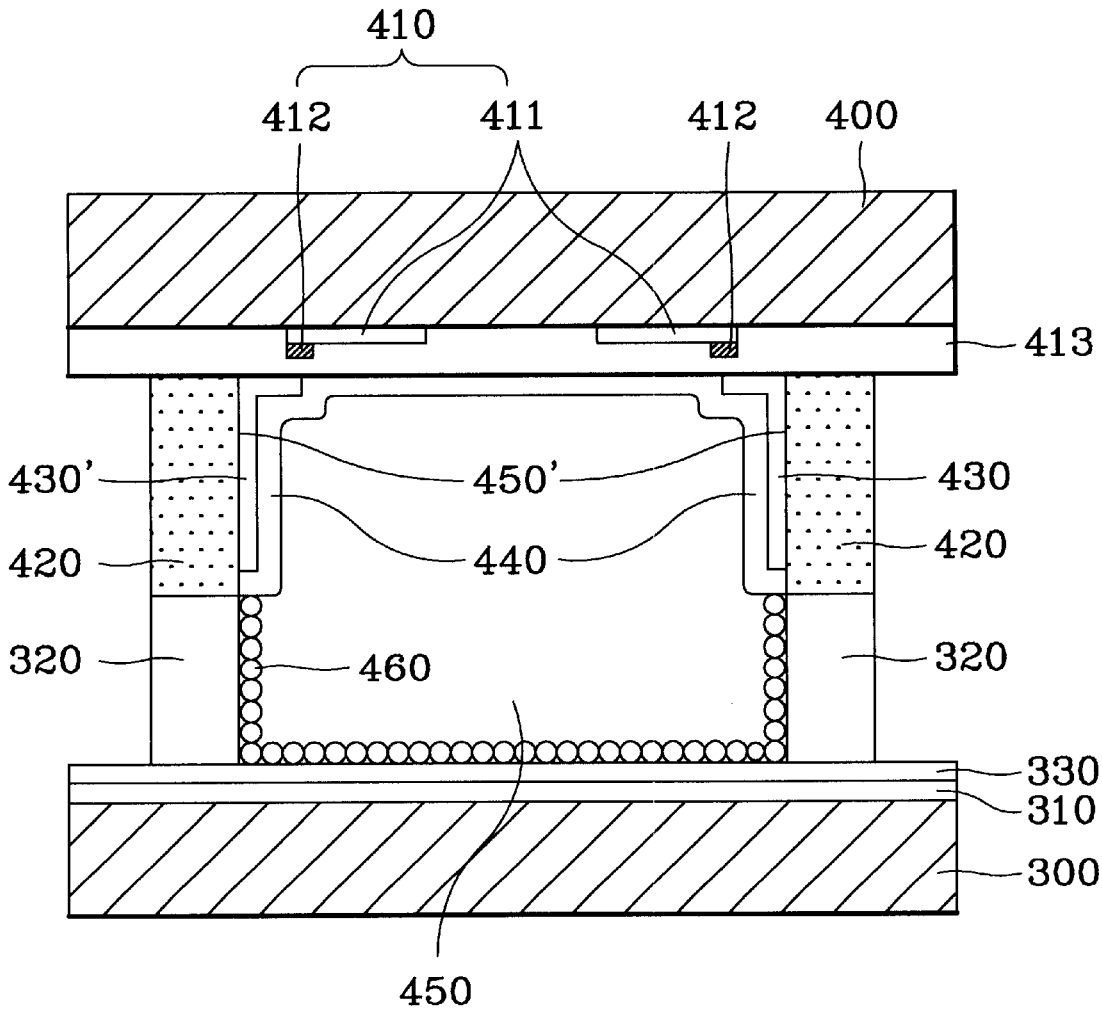
FIG. 7 is a diagram showing a structure of a plasma display panel having a lattice-shaped isolation wall according to the third embodiment of the present invention.

Furthermore, in this embodiment, a phosphor 460 is additionally formed at one side of the lower isolation wall 320 as well as on the upper substrate 300, as shown in FIG. 7.

Fourth Embodiment

Figure 8:
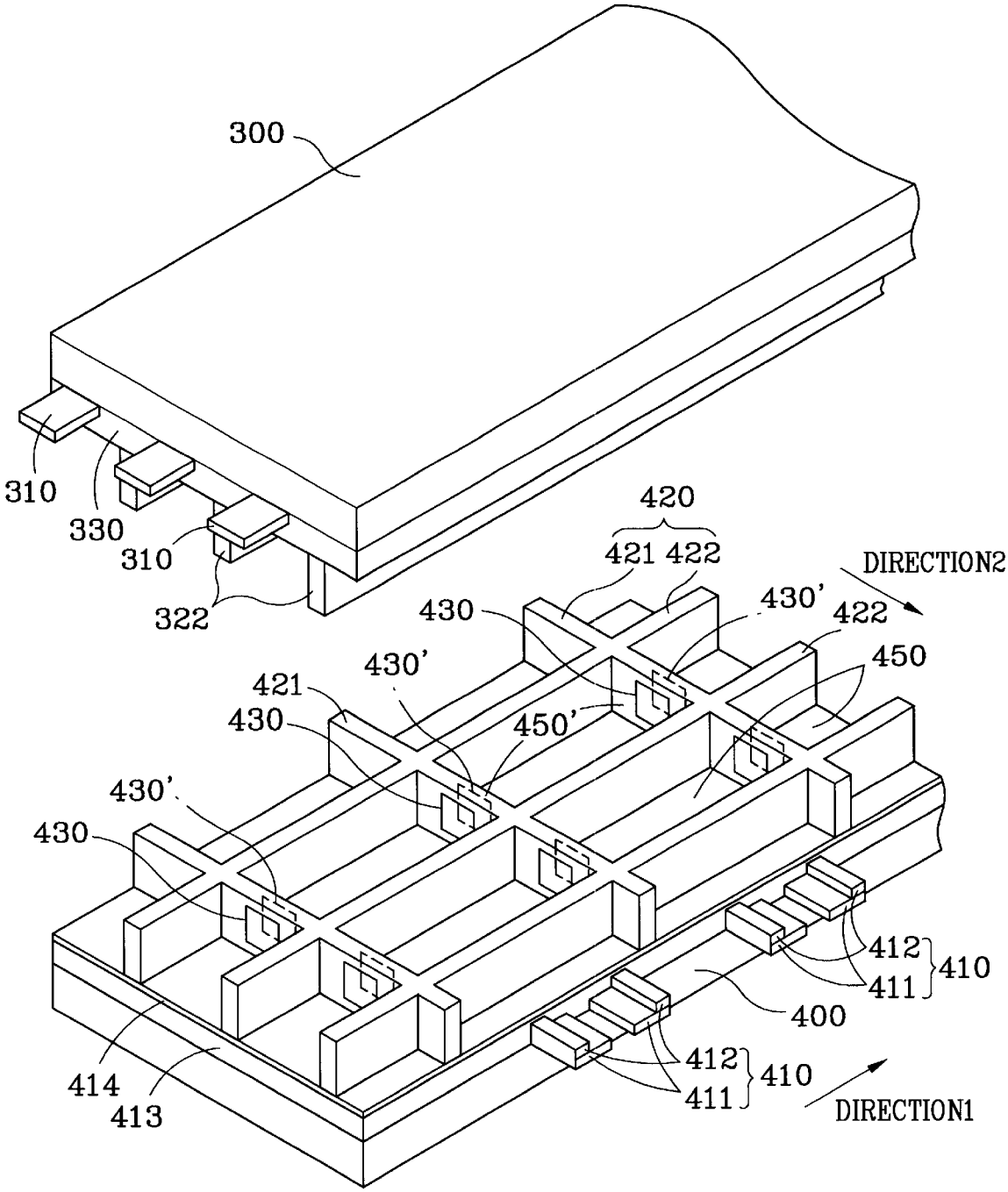
FIG. 8 is a diagram showing a structure of a plasma display panel having a lattice-shaped isolation wall according to a fourth embodiment of the present invention.

FIG. 8 illustrates a plasma display panel according to a fourth preferred embodiment of the present invention. The plasma display panel includes a lower substrate 300 and a plurality of address electrodes 310 formed on the lower substrate at a certain interval in a first direction (DIRECTION1). The plasma display panel further includes an upper substrate 400, and a plurality of upper electrodes 410 formed on the upper substrate in a second direction (DIRECTION2) to cross the address electrodes at a predetermined angle. An upper isolation wall 420 is formed on the upper substrate 400 to form a plurality of discharge areas 450 in areas where the address electrodes 310 cross the upper electrode 410. The isolation wall includes a plurality of first bars 421 and a plurality of second bars 422, and the first bars 421 successively extend to the second direction at a certain interval while the second bars 422 successively extending to the first direction crossing the second direction at a certain interval.

A lower isolation wall 322 is formed with the same stripe shape as the second bars 422 of the upper isolation wall to engage with second bars 422 of the upper isolation wall on the lower substrate to form a plurality of discharge areas 450 in areas where the address electrodes 310 cross the upper electrodes 410. The lower isolation wall includes a plurality of first bars and a plurality of second bars, where the first bars successively extend to the second direction at a certain interval and the second bars successively extend to the first direction crossing the second direction at a certain interval. The upper substrate is mated with the lower substrate to finish the plurality of discharge areas opened at some portions in areas where the address electrodes cross the upper electrodes.

A floating gate pair 430, 430' is formed in a corresponding discharge area, where two floating gate electrodes in each pair is formed on two opposite sides of the upper isolation wall respectively in the second direction. The upper electrodes are formed separated from each other between the discharge areas opened at some portion thereof.

As aforementioned, the plasma display panel according to the present invention has the following advantages.

Since the discharge distance between the two floating electrodes in pairs is longer than the distance between the upper electrodes, positive column discharge occurs. Thus, the plasma display panel of the present invention has a higher emitting efficiency and can obtain a screen of a higher luminance at the same power as compared with the related art plasma display panel, thereby reducing power consumption.

It will be apparent to those skilled in the art that various modifications and variations can be made in the plasma display panel according to the present invention without departing from the spirit or scope of the invention. Thus, it is intended that the present invention covers the modifications and variations of the invention provided they come within the scope of the appended claims and their equivalents.

What is claimed is:

1. A plasma display panel comprising:

a plurality of address electrodes successively formed on a rear substrate at a certain distance;

a plurality of upper electrodes successively formed on a front substrate opposite to the rear substrate to orthogonally cross the address electrodes;

an isolation wall formed between the rear substrate and the front substrate to form a plurality of lattice-shaped discharge areas in areas where the address electrodes cross the upper electrodes; and a plurality of floating electrode pairs, wherein each floating gate pair being formed in a corresponding discharge area, two floating gate electrodes in each pair being formed on two opposite sides of the isolation wall respectively, and the sides corresponding to both sides of the corresponding upper electrode.

2. The plasma display panel as claimed in claim 1, further comprising a passivation film which covers the floating electrodes.

3. The plasma display panel as claimed in claim 1, wherein the floating electrodes are either metal material or transparent conductive material.

4. The plasma display panel as claimed in claim 1, wherein the floating electrodes extend from an upper portion of one side of the isolation wall in each discharge area to some portion of the front substrate.

5. The plasma display panel as claimed in claim 1, wherein the upper electrodes are formed separated from each other between the discharge areas.

6. A plasma display panel comprising:

a plurality of address electrodes successively formed on a rear substrate at a certain interval;

a plurality of upper electrodes formed on a front substrate opposite to the rear substrate to orthogonally cross the address electrodes;

a lattice-shaped upper isolation wall formed on the front substrate to form a plurality of lattice-shaped discharge areas in areas where the address electrodes cross the upper electrodes;

a lower isolation wall formed on the rear substrate with the same shape as the upper isolation wall to form the plurality of lattice-shaped discharge areas in areas where the address electrodes cross the upper electrodes, the lower isolation wall being mated with the upper isolation wall to finish the plurality of lattice-shaped discharge areas; and a plurality of floating electrode pairs, wherein each floating gate pair being formed in a corresponding discharge area, two floating gate electrodes in each pair being formed on two opposite sides of the isolation wall respectively, and the sides corresponding to both sides of the corresponding upper electrode.

7. The plasma display panel as claimed in claim 6, further comprising a passivation film which covers the floating electrodes.

8. The plasma display panel as claimed in claim 6, wherein the floating electrodes are either metal material or transparent conductive material.

9. The plasma display panel as claimed in claim 8, wherein the transparent conductive material is Indium Tin Oxide.

10. The plasma display panel as claimed in claim 6, wherein the floating electrodes respectively extend from a side of the upper isolation wall to some portion of the front substrate.

11. The plasma display panel as claimed in claim 6, further comprising a dielectric layer formed on the front substrate and the upper electrodes, and a passivation film formed on the dielectric layer.

12. The plasma display panel as claimed in claim 6, further comprising a phosphor formed on sides of the lower isolation wall and over the rear substrate in each discharge area.

13. The plasma display panel as claimed in claim 6, wherein the upper electrodes are formed separated from each other between the discharge areas.

14. A plasma display panel comprising:

a plurality of address electrodes successively formed on a rear substrate at a certain interval;

a plurality of upper electrodes formed on a front substrate opposite to the rear substrate to orthogonally cross the address electrodes;

a lattice-shaped upper isolation wall formed on the front substrate to form a plurality of lattice-shaped discharge areas in areas where the address electrodes cross the upper electrodes;

a lower isolation wall formed on the rear substrate with a stripe shape to form the plurality of lattice-shaped discharge areas in areas where the address electrodes cross the upper electrodes, the lower isolation wall being mated with the upper isolation wall to finish the lattice-shaped discharge areas opened at some portions;

a plurality of floating electrode pairs, wherein each floating gate pair being formed in a corresponding discharge area, two floating gate electrodes in each pair being formed on two opposite sides of the isolation wall respectively, and the sides corresponding to both sides of the corresponding upper electrode.

15. The plasma display panel as claimed in claim 14, wherein the upper electrodes are formed separated from each other between the discharge areas.

16. A plasma display panel comprising:

a lower substrate;

a plurality of address electrodes successively formed on the lower substrate at a certain interval in a first direction;

an upper substrate;

a plurality of upper electrodes formed on the upper substrate in a second direction to cross the address electrodes at a predetermined angle;

an isolation wall formed between the upper substrate and the lower substrate to form a plurality of discharge areas in areas where the address electrodes cross the upper electrodes, the isolation wall including a plurality of first bars and a plurality of second bars, the first bars successively extending to the second direction at a certain interval and the second bars successively extending to the first direction crossing the second direction at a certain interval, the upper substrate being mated with the lower substrate to form the plurality of discharge areas in areas where the address electrodes cross the upper electrodes; and a plurality of floating electrode pairs, wherein each floating gate pair being formed in a corresponding discharge area and two floating gate electrodes in each pair being formed on two opposite sides of the isolation wall respectively in the second direction.

17. The plasma display panel as claimed in claim 16, wherein the address electrodes orthogonally cross the upper electrodes.

18. The plasma display panel as claimed in claim 16, wherein the respective floating electrode pairs are parallel to the upper electrodes on the opposite sides of the isolation wall in each discharge area.

19. The plasma display panel as claimed in claim 16, further comprising a dielectric layer formed on the upper electrodes and the upper substrate; and a passivation film on the dielectric layer.

20. The plasma display panel as claimed in claim 16, the floating electrodes are either metal material or Indium Tin Oxide material.

21. The plasma display panel as claimed in claim 16, wherein the floating electrode pairs extend from an upper side of the first bar in the isolation wall to some portion of the upper substrate.

22. The plasma display panel as claimed in claim 21, further comprising a passivation film which covers the respective floating electrode pairs.

23. The plasma display panel as claimed in claim 21, further comprising a passivation film which covers an exposed entire surface of the upper substrate and the upper electrodes as well as the respective floating electrode pairs.

24. The plasma display panel as claimed in claim 16, wherein the upper electrodes are formed separated from each other between the discharge areas.

25. A plasma display panel comprising:

a lower substrate;

a plurality of address electrodes formed on the lower substrate at a certain interval in a first direction;

an upper substrate;

a plurality of upper electrodes formed on the upper substrate in a second direction to cross the address electrodes at a predetermined angle;

an upper isolation wall formed on the upper substrate to form a plurality of discharge areas in areas where the address electrodes cross the upper electrodes, the isolation wall including a plurality of first bars and a plurality of second bars, the first bars successively extending to the second direction at a certain interval and the second bars successively extending to the first direction crossing the second direction at a certain interval;

a lower isolation wall formed with the same shape as the upper isolation wall to engage with the upper isolation wall on the lower substrate to form a plurality of discharge areas in areas where the address electrodes cross the upper electrodes, the isolation wall including a plurality of first bars and a plurality of second bars, the first bars successively extending to the second direction at a certain interval and the second bars successively extending to the first direction crossing the second direction at a certain interval, the upper substrate being mated with the lower substrate to finish the plurality of discharge areas in areas where the address electrodes cross the upper electrodes; and a plurality of floating electrode pairs, wherein each floating gate pair being formed in a corresponding discharge area and two floating gate electrodes in each pair being formed on two opposite sides of the upper isolation wall respectively in the second direction.

26. The plasma display panel as claimed in claim 25, wherein the upper electrodes are formed separated from each other between the discharge areas.

27. The plasma display panel as claimed in claim 25, wherein the address electrodes orthogonally cross the upper electrodes.

28. The plasma display panel as claimed in claim 25, wherein the respective floating electrode pairs are parallel to the upper electrodes on the opposite sides of the isolation wall in each discharge area.

29. The plasma display panel as claimed in claim 25, further comprising a dielectric layer formed on the upper electrodes and the upper substrate; and a passivation film formed on the dielectric layer.

30. The plasma display panel as claimed in claim 25, the floating electrode pairs are either metal material or Indium Tin Oxide material.

31. The plasma display panel as claimed in claim 16, wherein the floating electrode pairs extend from an upper side of the first bar in the isolation wall in a corresponding discharge area to some portion of the upper substrate.

32. The plasma display panel as claimed in claim 31, further comprising a passivation film which covers the respective floating electrode pairs.

33. The plasma display panel as claimed in claim 31, further comprising a passivation film which covers an exposed entire surface of the upper substrate and the upper electrodes as well as the respective floating electrode pairs.

34. A plasma display panel comprising:

a lower substrate;

a plurality of address electrodes formed on the lower substrate at a certain interval in a first direction;

an upper substrate;

a plurality of upper electrodes formed on the upper substrate in a second direction to cross the address electrodes at a predetermined angle;

an upper isolation wall formed on the upper substrate to form a plurality of discharge areas in areas where the address electrodes cross the upper electrodes, the isolation wall including a plurality of first bars and a plurality of second bars, the first bars successively extending to the second direction at a certain interval and the second bars successively extending to the first direction crossing the second direction at a certain interval;

a lower isolation wall formed with the same stripe shape as the second bars of the upper isolation wall to engage with second bars of the upper isolation wall on the lower substrate to form a plurality of discharge areas in areas where the address electrodes cross the upper electrodes, the lower isolation wall including a plurality of first bars and a plurality of second bars, the first bars successively extending to the second direction at a certain interval and the second bars successively extending to the first direction crossing the second direction at a certain interval, the upper substrate being mated with the lower substrate to finish the plurality of discharge areas opened at some portions in areas where the address electrodes cross the upper electrodes; and a plurality of floating electrode pairs, wherein each floating gate pair being formed in a corresponding discharge area, two floating gate electrodes in each pair being formed on two opposite sides of the upper isolation wall respectively in the second direction.

35. The plasma display panel as claimed in claim 34, wherein the upper electrodes are formed separated from each other between the discharge areas opened at some portion thereof.

* * * * *